US005894644A

United States Patent [19]

Mravic

[11] Patent Number: 5,894,644

[45] Date of Patent: Apr. 20, 1999

[54] LEAD-FREE PROJECTILES MADE BY LIQUID METAL INFILTRATION

[75] Inventor: Brian Mravic, North Haven, Conn.

[73] Assignee: Olin Corporation, New Haven, Conn.

[21] Appl. No.: 09/092,611

[22] Filed: Jun. 5, 1998

[51] Int. Cl.[6] ..... B21K 21/06; F42B 10/00

[52] U.S. Cl. ..... 29/1.22; 102/331; 102/517

[58] Field of Search ..... 102/331, 517; 29/1.22

[56] References Cited

U.S. PATENT DOCUMENTS

| | | | |
|---|---|---|---|
| 2,867,554 | 1/1959 | Wilson et al. | 148/3 |
| 5,189,252 | 2/1993 | Huffman et al. | 102/517 X |
| 5,333,550 | 8/1994 | Rodney et al. | 102/331 |
| 5,385,101 | 1/1995 | Corzine et al. | 102/517 X |
| 5,399,187 | 3/1995 | Mravic et al. | 102/517 X |
| 5,527,376 | 6/1996 | Amick et al. | 102/517 X |
| 5,665,808 | 9/1997 | Bilsbury et al. | 102/506 X |
| 5,760,331 | 6/1998 | Lowden et al. | 102/506 |
| 5,814,759 | 9/1998 | Mravic et al. | 102/517 |
| 5,831,188 | 11/1998 | Amick et al. | 102/517 X |

*Primary Examiner*—Peter A. Nelson

*Attorney, Agent, or Firm*—William A. Simons; Wiggin & Dana

[57] ABSTRACT

A process for making lead-free projectiles such as bullets using liquid metal infiltration to make a projectile having a density similar to lead.

9 Claims, No Drawings

LEAD-FREE PROJECTILES MADE BY LIQUID METAL INFILTRATION

BACKGROUND OF THE INVENTION

1. Field of the Invention

This invention relates to the process of making lead-free projectiles such as bullets and shot by the technique of liquid metal infiltration.

2. Brief Description of the Art

Liquid metal infiltration is a well known technique for making certain metal objects where a porous preform made of one or more constituents having a relatively high melting temperature is infiltrated by a molten metal or alloy whose melting point is less than that of the constituents making up the porous preform. See Claus G. Goetzek, *Infiltration*, Metals Handbook Ninth edition, Vol. 7, Powders Metallurgy, pages 551–566 (1984); for a detailed description of this operation.

Liquid metal infiltration has been used to make a wide variety of metal articles of manufacturing, including electrical contacts and electrodes, rocket nozzles, jet engine components, tools, mechanical parts and bearings. It is believed this technique has never been used to make projectiles, specifically, lead-free projectiles that have similar ballistic performance characteristics similar to those of lead-type projectiles.

BRIEF SUMMARY OF THE INVENTION

Accordingly, one aspect of the present invention is directed to a process of making lead-free projectiles such as bullets or shot having densities and ballistic performance characteristics like similar to lead-containing projectiles, comprising the steps of:

(1) forming a porous preform from at least one preform metal powder having an average density greater than that of lead;

(2) infiltrating at least one liquid metal into the porous preform; said infiltrating liquid metal having an average density less than lead and a melting temperature less than one of metals in the preform;

(3) allowing the liquid infiltration metal to solidify in the pores of the preform metal powder; wherein the relative amounts of the preform metal and infiltrating metal will result in a product having a density that is from about 90% to about 110% of the density of lead; and (4) forming said product into a projectile shape.

DETAILED DESCRIPTION OF THE PREFERRED EMBODIMENTS

This invention relates to employing liquid metal infiltration. In particular, a porous preform made of one or more constituents is infiltrated with a molten metal or alloy whose melting point is less than the melting point of the constituents of the porous preform.

The porous perform can consist simply of a blend of powders of the desired metals or metal alloys that are constrained to a desired shape close to the shape of the desired final object. These powders can be merely poured into a mold cavity of the desired size and shape and, are optionally densified by tapping or by lightly pressing.

Alternatively, a conventional powder metallurgy press and die set can be used to compact the powders into a green preform that can be then inserted into a second mold cavity in which infiltration will take place. To ensure sufficient infiltration, it may be desirable to deoxidize the preform metal powders in a reducing atmosphere. This will ensure melting of the preform powders by the infiltrating metal or alloy.

As stated above, the metal or alloy of metal powder or mixture of metal powders used as a preform must have an average density greater than lead. Suitable materials for making this preform include powders of tungsten, tungsten carbide, ferrotungsten or mixtures thereof. Furthermore, these materials may be blended with powders of other high-melting metal such as iron, copper or nickel to reduce the cost of the preform.

If a net shaping process for a projectile is employed, the preform is made in the general shape of a projectile such as a bullet or shot. This may be easily accomplished by simply making the mold holding the preform in the desired projectile shape. Alternatively, the mold holding the preform may be in the shape of a billet. After the liquid metal infiltration (LMI) operation, the resulting billets may be extruding them into rods, cutting or chopping those rods into appropriate lengths and then plastically forming or machining bullets or bullet cores from those cut pieces. Also, these billets, after the LMI operation, may be made into shot by extruding them into rods, drawing the rods into wire, chopping the wire into lengths, and forming shot from these lengths. Between those steps or as a final step or both, the material may be optionally annealed at a temperature below the melting temperature of infiltrating metal to soften the product.

The mold containing the preform must be made of a material capable of withstanding temperatures higher than the melting point of the low melting metal that will be used to infiltrate the preform. Suitable mold materials for most applications are materials such as graphite or some other machineable ceramic. The mold can contain more than one cavity, which allows multiple projectiles to be made with a single heat treatment.

After the preform is in the mold cavity, a suitable portion of the low melting metal or alloy is placed in contact with the preform, but typically on top of the preform. The amount to be used is the amount required to completely fill the cavities in the porous preform and to achieve the desired lead-like density. The infiltrating metal can be in the form of a slug, chips or powder. Suitable materials for infiltrating liquid metal are any metals having a density less than lead and a melting point less than that of the preform. These include copper, zinc, tin, bismuth and alloys of copper and zinc or alloys of copper, and tin.

The mold containing the preforms and infiltrating metal or alloy is then heated to a temperature above the melting point of the infiltrating liquid metal in a suitable, non-oxidizing atmosphere such as argon, nitrogen or mixtures of one or more of these gases and hydrogen. The atmosphere can also be a vacuum. Upon melting, the molten metal or alloy infiltrates the porous preform under the influence of gravitational and capillary forces, completely filling the pores.

The result is a product that is essentially fully dense, having a lead-like density which is between the density of the material or materials making up the preform and that of the infiltrating metal or alloy. The term "essentially fully dense" as used herein refers to products that are essentially free of internal porosity. The density also depends on the volume fraction of porosity in the preform. The volume fraction of porosity in an uncompacted powder preform depends on the size distribution of the powder. This can be tailored to optimize the properties of the final product. In contrast to the products of this invention, it is difficult or impossible to make fully dense products of the same materials by conventional powder metallurgical techniques.

A major objective of this invention is to achieve a final density close to that of lead so that the projectile will match some of the most important ballistic performance characteristics of lead. Therefore, the metal alloys making up the preform must have an average density greater than that of lead. The density of the infiltrating metal or alloy will necessarily be less than that of lead.

After solidification is complete, the formed product or part is further processed to make the desired product. If the net shaping process is used, the combined infiltrated metals are already in the general shape of the desired projectile (e.g., a bullet or bullet core), the formed part requires only a mechanical sizing operation or a small amount of machining to form the finished bullet or bullet core. A conventional metal jacket or plastic coating can be attached to the bullet or bullet core to protect the barrel of the firearm from being damaged. If one of the alternative projectile-forming processes as explained above is used, then the resulting billet is converted by them into desired bullet or shot shape.

The following examples further illustrate the present invention. All parts and percentages are by weight and temperatures are degrees Celsius unless explicitly stated otherwise.

EXAMPLES

The apparent density of ferrotungsten powder with a size range of 30 to 325 mesh is about 6.86 g/cc. The density of ferrotungsten with a tungsten content of about 78.6 percent by weight is about. 14.4 g/cc. Therefore, the volume fraction of the space between the powder particles is 1–6.86/14.4 or about 0.524. Therefore, the expected density of a fully dense part made by infiltrating this powder would be the sum of 47.6% of the density of ferrotungsten and 52.4% of the density of the infiltrating meal or alloy. With infiltrating metals such as Cu, brass (with 30% Zn), Zn, Sn, or Bi, the full density of combined metals would be expected to be 11.6, 11.3, 10.6, 10.7 or 12.0 g/cc, respectively. The density of lead is 11.3 g/cc.

In order to reduce the cost of the preform, it could be made of a mixture of ferrotungsten and another metal such as iron. This would result in a product with lower cost but lower density.

Metal infiltrated ferrotungsten powder cylinders were fabricated using copper and the copper alloy C260 (brass) as the infiltrating metals. The composites were 58–61% ferrotungsten in the case of copper and 56% ferrotungsten in the case of brass. A graphite mold was used, and the heating atmosphere was 96% nitrogen-4% hydrogen. The temperatures used were 1135° C. and 1005° C., respectively, with holding times at temperature of approximately 5 minutes. The densities achieved were 10.6–11.2 g/cc and 10.6 g/cc, respectively.

The compressive strength of the copper-infiltrated ferrotungsten material was 88–92 ksi, while that of the brass-infiltrated ferrotungsten material was greater than 102 ksi. When cylinders approximately 0.5 inches long and 0.355 inches in diameter of these metals were subjected to a drop weight test using an input energy of 240 foot pounds (an energy density of about 4850 foot pounds per cubic inch), they exhibited slight cracking but remained intact.

To achieve a density of 10.6–11.2 using the same ferrotungsten and copper and conventional powder metallurgical techniques, it would require at least 72% by weight of ferrotungsten. Therefore, since ferrotungsten is quite expensive, the present invention offers a significant cost advantage over conventional powder metallurgical processes. It is also expected that the equipment costs for the processes described in the present invention would be significantly less than those to produce the same parts using conventional powder metallurgy procedures, since the present invention requires no expensive presses or expensive dies.

While the invention has been described above with reference to specific embodiments thereof, it is apparent that many changes, modifications and variations can be made herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A process for making lead-free projectiles comprising the steps of:

(1) forming a porous preform from at least one preform metal powder having an average density greater than that of lead;

(2) infiltrating at least one liquid metal into the porous preform; said infiltrating liquid metal having an average density less than lead and a melting temperature less than one of metals in the preform; and (3) allowing the liquid infiltration metal to solidify in the pores of the preform metal powder; wherein the relative amounts of the preform metal and infiltrating metal in the solidified combination will result in a product having a density that is form about 90% to about 110% of the density of lead; and (4) forming said product into a projectile shape.

2. The process of claim 1 wherein the projectile is a bullet or bullet core.

3. The process of claim 1 wherein the projectile is a shot.

4. The process of claim 1 wherein the preform metal is selected from the group consisting of tungsten, tungsten carbide, ferrotungsten and mixtures thereof.

5. The process of claim 4 wherein the preform metal additionally contains at least one metal powder selected from the group consisting of iron powder, copper powder and nickel powder.

6. The process of claim 1 wherein said liquid infiltrating metal is selected from the group consisting of copper, zinc, tin, bismuth, alloys of copper and zinc and alloys of copper and tin.

7. The process of claim 1 wherein step (4) is accomplished by forming the porous preform in a mold having the shape of the projectile.

8. The process of claim 1 wherein the projectile is a bullet or bullet core and step (4) comprises:

(4a) extruding the product into a rod;

(4b) cutting the rod into lengths;

(4c) forming bullets or bullet cores from these cut lengths; and optionally (4d) after one or more of steps (4a), (4b) and (4c), annealing the material to soften it at a temperature below the meeting temperature of the infiltrating metal.

9. The process of claim 1 wherein the projectile is a shot and step (4) comprises:

(4a) extruding the product into rod;

(4b) drawing the rod into wire;

(4c) cutting the wire into lengths;

(4d) forming shots from these cut lengths; and optionally (4e) after one or more of steps (4a), (4b), (4c) and (4d), annealing the material to soften it at a temperature below the melting temperature of the infiltrating metal.

* * * * *

UNITED STATES PATENT AND TRADEMARK OFFICE

CERTIFICATE OF CORRECTION

PATENT NO : 5,894,644

DATED : April 20, 1999

INVENTOR(S) : Brian Mravic

It is certified that error appears in the above-identified patent and that said Letters Patent is hereby corrected as shown below:

At column 1, line 16, "Goetzek" should read --Goetzel--.
At column 2, line 3, "melting" should read --wetting--.
At column 4, line 28, "form" should read --from--.

Signed and Sealed this

Twenty-first Day of March, 2000

*Attest:*

Q. TODD DICKINSON

*Attesting Officer*

*Commissioner of Patents and Trademarks*